US006571706B1

(12) United States Patent
Conzelmann et al.

(10) Patent No.: US 6,571,706 B1
(45) Date of Patent: Jun. 3, 2003

(54) METHOD FOR TWO-SIDED PRINTING OF A SHEET OF PRINTING MATERIAL, AND A SHEET-FED ROTARY PRINTING PRESS FOR PERFORMING THE METHOD

(75) Inventors: Daniel Conzelmann, Dielheim (DE); Karl-Heinz Seefried, Zuzenhausen (DE); Günter Stephan, Wiesloch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 242 days.

(21) Appl. No.: 09/255,990

(22) Filed: Feb. 23, 1999

(65) Prior Publication Data

(65)

(30) Foreign Application Priority Data

Feb. 23, 1998 (DE) ..... 198 07 544

(51) Int. Cl.[7] ..... B41F 35/00

(52) U.S. Cl. ..... 101/425; 101/211; 101/229

(58) Field of Search ..... 101/171, 211, 101/212, 425, 416.1, 417, 419, 423, 424, 424.1, 483, 494

(56) References Cited

U.S. PATENT DOCUMENTS

| | | | | | |
|---|---|---|---|---|---|
| 1,089,453 | A | * | 3/1914 | Wood | 101/425 |
| 1,120,840 | A | * | 12/1914 | Niles | 101/425 |
| 2,262,978 | A | * | 11/1941 | Vesely | 101/425 |
| 3,245,835 | A | * | 4/1966 | Gallino | 101/425 |
| 3,395,042 | A | | 7/1968 | Herbert, Jr. | |
| 3,586,437 | A | * | 6/1971 | Dietz et al. | 101/228 |
| 3,877,371 | A | * | 4/1975 | Jaffa | 101/425 |
| 4,082,037 | A | * | 4/1978 | Grindley et al. | 101/425 |
| 4,643,775 | A | * | 2/1987 | Reba et al. | 134/15 |
| 5,007,339 | A | * | 4/1991 | Germann | 101/177 |
| 5,259,308 | A | * | 11/1993 | Wirz | 101/230 |
| 5,289,774 | A | * | 3/1994 | Stanka | 101/423 |
| 5,642,670 | A | * | 7/1997 | Takeuchi | 101/423 |

FOREIGN PATENT DOCUMENTS

| | | |
|---|---|---|
| DE | 697 620 | 9/1940 |
| DE | 1 636 315 | 3/1970 |
| DE | 2 165 960 | 4/1973 |
| DE | 36 14 774 A1 | 1/1988 |
| DE | 37 40 044 A1 | 6/1989 |
| DE | 44 35 307 A1 | 4/1996 |
| DE | 195 03 619 A1 | 8/1996 |

OTHER PUBLICATIONS

Utility Model G 88 13 228.5, dated Feb. 2, 1989, device for removing dirt from a print medium.

Japanese Patent Abstract No. 09076478 A (Kenji), dated Mar. 25, 1997.

Japanese Patent Abstract No. 09039216 A (Kenji), dated Feb. 10, 1997.

Hans–Joachim Teichmann: "Berührungslos enstauben", touchless dusting, Offset–Praxis, 10/97, pp. 74, 75.

* cited by examiner

*Primary Examiner*—Eugene H. Eickholt
(74) *Attorney, Agent, or Firm*—Laurence A. Greenberg; Werner H. Stemer; Gregory L. Mayback

(57) ABSTRACT

A method for two-sided printing of a sheet of printing material having a front side and a rear side, in a sheet-fed rotary printing press, wherein the front side is cleaned before being printed, includes also cleaning the rear side of the sheet before printing thereon; and a sheet-fed rotary printing press for performing the method.

3 Claims, 5 Drawing Sheets

METHOD FOR TWO-SIDED PRINTING OF A SHEET OF PRINTING MATERIAL, AND A SHEET-FED ROTARY PRINTING PRESS FOR PERFORMING THE METHOD

BACKGROUND OF THE INVENTION

Field of the Invention

The invention relates to a method for two-sided printing of a sheet of printing material having a front side and a rear side, in a sheet-fed rotary printing press, in which the front side is cleaned before being printed, and to a sheet-fed rotary printing press for two-sided printing of a sheet of printing material having a front side and a rear side and, in particular, for performing the method, the printing press having at least one printing unit for printing the front side and at least one other printing unit for printing the rear side, and having a first cleaning device for cleaning the front side before it is printed.

In German Patent 18 39 446, a rotary dust removal machine for paper sheets is described, in which both sides of the paper sheets are completely cleaned by roller brushes. This machine can be combined with other rotary processes or can be provided as an accessory to existing machines.

In the published German Patent Document DE 4 435 307 A1, a method and a device are described which ensure the realization, in sheet-fed offset printing presses, of other operations in addition to printing in a single sheet pass. Due to the provision of a printing blanket on the form cylinder, or due to the surface of the impression cylinder, the amount of dust in the printing material fed to the printing units is reduced.

The hereinaforementioned prior art does not relate to printing on both sides of a sheet of printing material, nor does it provide any solutions for avoiding problems which arise in such a process.

In the published German Patent Document DE 4 036 253 C1, a sheet-fed rotary offset printing press of in-line construction for smear-free printing of cardboard and paper in multicolor two-sided or recto/verso printing is described that includes an upending or tumbling device. One advantageous possible use of the upending device occurs in printing cardboard sheets, the top surface of which to be printed must be subjected to a cleaning treatment and thereafter, before recto printing on that cleaned top surface, the sheet is reversed by the upending device and verso printing is performed on the bottom surface thereof, after which, another reversal of the sheet takes place, with smear-free recto printing being performed on the previously treated top side of the sheet.

In the journal Offset-Praxis [Offset Industry] October 1997, beginning on p. 74, a contact-free dust removal system for printing material in sheet-fed and web-fed printing presses for offset, rotogravure and flexographic printing is described which, in sheet-fed offset machines, for example, is mounted in the first printing unit, whereas, in recto/verso or first-form and perfector printing presses, it is disposed in the first impression cylinder after the sheet reversal.

The devices described in the two last-mentioned references serve to provide one-sided cleaning of the sheet of printing material, but do not contribute to overcoming the problems occurring in two-sided printing.

SUMMARY OF THE INVENTION

It is accordingly an object of the invention to provide a method for two-sided printing of a sheet of printing material, and a sheet-fed rotary printing press for performing the method, by which the printing quality is increased, and contamination of the printing press is reduced.

With the foregoing and other objects in view, there is provided, in accordance with one aspect of the invention, a method for two-sided printing of a sheet of printing material having a front side and a rear side, in a sheet-fed rotary printing press, wherein the front side is cleaned before being printed, which comprises also cleaning the rear side of the sheet before printing thereon.

In accordance with another feature, the method of the invention includes printing in multiple colors on at least one of the front and the rear sides of the sheet.

In accordance with a further feature, the method of the invention includes printing in multiple colors on both the front and the rear sides of the sheet.

In accordance with an added feature, the method of the invention includes cleaning both the front and the rear sides of the sheet, and printing on both the front and the rear sides of the sheet within a single pass of the sheet of printing material through the sheet-fed rotary printing press.

In accordance with an additional feature, the method of the invention includes initially cleaning the front side of the sheet with a first cleaning device, and thereafter cleaning the rear side of the sheet with a second cleaning device disposed downline of the first cleaning device, as viewed in a sheet transport direction.

In accordance with yet another feature, the method of the invention includes performing in the following order the steps of cleaning the front side of the sheet, printing on the front side of the sheet, cleaning the rear side of the sheet, and printing on the rear side of the sheet.

In accordance with yet a further feature, the printing on the front and the rear sides of the sheet is multicolor printing.

In accordance with yet an added mode, the method of the invention includes performing the steps in a sheet-fed rotary printing press embodied as a recto/verso printing press.

In accordance with yet an additional feature, the method of the invention includes performing a contact-free cleaning method for cleaning at least one of the front and the rear sides of the sheet.

In accordance with still another feature, the method of the invention includes performing a cleaning method acting by contact for cleaning at least one of the front and the rear sides of the sheet.

In accordance with still a further feature, the method of the invention includes both a contact-free cleaning method and a cleaning method acting by contact for cleaning at least one of the front and the rear sides of the sheet.

In accordance with still an added feature, the method of the invention includes cleaning the front side of the sheet by at least one method like an at least one method for cleaning the rear side of the sheet.

In accordance with another aspect of the invention, there is provided a sheet-fed rotary printing press for two-sided printing of a sheet of printing material having a front side and a rear side, comprising at least a first printing unit for printing the front side and at least a second printing unit for printing the rear side of the sheet, a first cleaning device for cleaning the front side of the sheet before it is printed, and a second cleaning device for cleaning the rear side of the sheet before it is printed.

In accordance with another feature of the invention, the second cleaning device is disposed downline of the first cleaning device, as viewed in a sheet transport direction.

In accordance with a further feature of the invention, the sheet-fed rotary printing press includes a reversing device disposed between the first printing unit and the second printing unit, as viewed in a sheet transport direction.

In accordance with an added feature of the invention, the sheet-fed rotary printing press includes a plurality of printing units, particularly at least four printing units, preceding the reversing device, as viewed in the sheet transport direction.

In accordance with an additional feature of the invention, the sheet-fed rotary printing press includes a plurality of printing units, particularly at least four printing units, following the reversing device, as viewed in the sheet transport direction.

In accordance with yet another feature of the invention, the first cleaning device is assigned to an impression cylinder of the first printing unit.

In accordance with yet a further feature of the invention, the second cleaning device is assigned to an impression cylinder of the second printing unit.

In accordance with yet an added feature of the invention, the sheet-fed rotary printing press includes a sheet transfer device having at least one sheet transport drum disposed between two of the printing units preceding the reversing device, and the second cleaning device being assigned to the at least one sheet transport drum.

In accordance with yet an additional feature of the invention, the sheet transfer device includes three sheet transport drums, and the second cleaning device is assigned to the first of the sheet transport drums of the sheet transfer device, as viewed in the sheet transport direction.

In accordance with still another feature of the invention, the sheet transfer device to which the second cleaning device is assigned is disposed directly downline of the first printing unit.

In accordance with still a further feature of the invention, the reversing device includes at least one sheet transport drum, and the second cleaning device is assigned to the one sheet transport drum.

In accordance with still an added feature of the invention, the reversing device includes three sheet transport drums, and the second cleaning device is assigned to the first of the sheet transport drums of the reversing device, as viewed in the sheet transport direction.

In accordance with still an additional feature of the invention, the first cleaning device is embodied as a cleaning unit disposed between a sheet feeder and the first printing unit.

In accordance with another feature of the invention, the second cleaning device is embodied as a cleaning unit disposed between the reversing device and the second printing unit.

In accordance with a further feature of the invention, the second cleaning device is embodied as a cleaning unit disposed immediately preceding the reversing device, as viewed in the sheet transport direction.

In accordance with an added feature of the invention, the first cleaning device and the second cleaning device are of identical construction.

In accordance with an additional feature of the invention, the at least one of the cleaning devices is embodied as a pneumatic cleaning device.

In accordance with yet another feature of the invention, the pneumatic cleaning device is at least one of a suction and a blower device.

In accordance with yet a further feature of the invention, at least one of the cleaning devices is embodied as a stripper device.

In accordance with yet an added feature of the invention, the at least one cleaning device is selected from the group consisting of a brush, a roller and a brush roller.

In accordance with yet an additional feature of the invention, at least one cleaning device is embodied as a pneumatically supported stripper device.

In accordance with still another feature of the invention, the pneumatically supported stripper device is embodied as a suction brush.

In accordance with a concomitant feature of the invention, the reversing device is selectively drivable in a recto printing mode and in a verso printing mode.

Thus, the method for two-sided printing of a sheet of printing material having a front side and a rear side, in a sheet-fed rotary printing press, wherein the front side is cleaned before being printed, is improved by cleaning the rear side before printing thereon.

The sheet-fed rotary printing press for two-sided printing of a sheet of printing material having a front side and a rear side, in particular for performing the method of the invention, having at least one printing unit for printing the front side and at least one second printing unit for printing the rear side of a sheet, and having a first cleaning device that cleans the front side before it is printed, is improved by providing a second cleaning device for cleaning the rear side before it is printed, the second cleaning device, in particular, being disposed downline of the first cleaning device, in the sheet transport direction.

As an alternative to the last-mentioned feature, provision may be made for the cleaning devices to be disposed at the same location with respect to the sheet transport, facing one another, for simultaneously cleaning both sides of the sheet of printing material that is passed between the cleaning devices.

In a first preferred variant, respectively, of the method of the invention, at least one of the two sides of the sheet is printed in multiple colors, and in particular, both the front side and the rear side are printed in multiple colors. The ink colors can be printed either simultaneously or successively on whichever side of the sheet is to be printed. Preferably, one ink color after the other is applied to the sheet of printing material, one ink color being applied per printing unit.

In another variant of the method of the invention, the cleaning of both sides of the sheet and the printing of both sides of the sheet are performed within a single pass of the sheet of printing material through the sheet-fed rotary printing press. This mode is distinguished by especially high effectiveness. In a sheet-fed rotary printing press not embodied as a perfecting press, a first sheet pass for printing the front side and a second sheet pass for printing the rear side may also be provided.

In another variant, the front side is cleaned first. Following the cleaning of the front side, the rear side is cleaned. The cleaning of the rear side can be performed immediately after the cleaning of the front side, or after the front side is printed in the interim. Preferably, both sides, respectively, of the sheet are cleaned with a cleaning device provided exclusively for cleaning the surface of the printing material.

In another variant of the method, the following method steps are performed in succession: first, cleaning the front side, and subsequently printing thereon. Next, cleaning the rear side, and likewise printing thereon afterwards. Two-sided cleaning of the sheet of printing material may also be provided for, followed by printing on the front side and then printing on the rear side.

In another variant of the method of the invention, to perform the method steps, a sheet-fed rotary printing press embodied for two-sided printing is used. Preferably, a first-form and perfecting or recto/verso printing press of in-line construction is used, having one impression cylinder guiding the sheet of printing material per printing unit. However, a satellite printing press embodied as a recto/verso or first-form and perfecting press can also be used. Such a machine is described, for example, in the published German Patent Document DE 195 03 619 A1, and is distinguished by having a plurality of printing form cylinders, or printing devices, respectively, comprising one printing form cylinder and one rubber blanket cylinder, assigned to a common impression cylinder. With such a printing press, the sheet of printing material guided by a first impression cylinder can be printed on the front side with at least four colors in succession. The sheet of printing material is then transferred to a second, identically embodied impression cylinder, so that the sheet of printing material guided on this impression cylinder is then printed on the rear side thereof with four or more colors.

In another variant of the method of the invention, the cleaning of at least one of the sides of the sheet is performed under the action of a contact-free cleaning method. This embodiment is especially advantageous if the sheet of printing material, on the previously printed front side, lies on a cylinder, and the cleaning of the yet unprinted rear side is to be performed before that side is also printed. In this way, the deposit of fresh printing ink from the rear side onto the cylinder transporting the sheet of printing material is avoided.

In another variant of the method of the invention, the cleaning of at least one of the sides of the sheet is performed by the use and by the action, respectively, of a cleaning method that works by contact. With a cleaning method working by contact, even dust adhering stubbornly to the surface of the printing material can be removed effectively.

An another variant of the method provides for cleaning at least one of the sides of the sheet, both a contact-free cleaning method and a cleaning method acting by contact being employed. With this combination, very thorough cleaning of the surface of the printing material is attained, and paper particles, for example, adhering to the surface of the printing material can be loosened with a brush and vacuumed off by a suction device.

An another variant of the method of the invention proposes that, for cleaning the front side, the same cleaning method or methods be employed as for cleaning the rear side. This mode of the method of the invention makes a relatively uncomplicated construction of the sheet-fed rotary printing press possible. For example, suction brushes can be used for cleaning both the front side and the rear side of the sheet. Furthermore, for cleaning the front side, a different cleaning method or methods can be employed than for cleaning the rear side.

One embodiment of the sheet-fed rotary printing press according to the invention has a reversing device disposed between the first printing unit and the second printing unit in the sheet transport direction. In another embodiment of the sheet-fed rotary printing press, the reversing device is preceded in the sheet transport direction by a plurality of printing units, in particular at least four printing units. With this embodiment, multicolor printing of a front side, and in particular four-color printing, can be performed.

In another embodiment of the sheet-fed rotary printing press, the reversing device is followed in the sheet transport direction by a plurality of printing units, in particular at least four printing units. With this embodiment, multicolor printing of the rear side of the sheet, in particular four-color printing, can be performed. A sheet-fed rotary printing press having the features of both the second and the third embodiment is especially advantageous. With such a sheet-fed rotary printing press, two-sided multicolor printing, in particular four-color printing on both sides, can be performed.

Another embodiment of the sheet-fed rotary printing press calls for the first cleaning device to be assigned to an impression cylinder of the first printing unit. By the first printing unit, there is meant, according to the invention, the printing unit which prints the first of a plurality of colors, or the single printing ink, onto the front side of the sheet. By the first cleaning device, there is meant the cleaning device that cleans the front side. The fourth embodiment of the sheet-fed rotary printing press offers the advantage that the sheet of printing material is cleaned on the front side thereof before it receives the first imprint on the front side, which improves the quality of the imprint.

In another embodiment of the sheet-fed rotary printing press, the second cleaning device is assigned to an impression cylinder of the second printing unit. By the second printing unit, according to the invention, there is meant the first of a plurality of printing units, or the single printing unit, in which printing of the rear side of the sheet of printing material is performed. The second cleaning device is understood according to the invention to mean the cleaning device that cleans the rear side of the sheet of printing material. The fifth embodiment offers the advantage that the rear side is cleaned before the first imprint is performed thereon. This embodiment has the further advantage that contaminants that have gotten onto the rear side in the previous printing of the front side are removed from the rear side before it is printed for the first time. Preferably, in the last two embodiments of the sheet-fed rotary printing press, the first and second cleaning device, respectively, are assigned to the impression cylinder, the cleaning device being disposed, in the sheet transport direction, upline of a printing nip defined by the impression cylinder and a rubber blanket cylinder or a printing form cylinder. The sheet of printing material can be cleaned immediately before it passes through the printing nip. Structurally, the disposition of the cleaning device in the region of the nip formed by the two printing cylinders is very favorable, because the existing structural space can thus also be optimally utilized. The impression cylinder supports the sheet, that lies thereon, from the side with which it is in contact, while the cleaning of the other side of the sheet is being performed.

In another embodiment of the sheet-fed rotary printing press, a sheet transfer device is disposed between two of the printing units preceding the reversing device, and the sheet transfer device includes at least one sheet transport drum to which the second cleaning device is assigned. The sheet transport drum supports the cleaning of the sheet of printing material lying thereon, in the same manner as an impression cylinder.

In another embodiment of the sheet-fed rotary printing press, the sheet transfer device includes three sheet transport drums, and the second cleaning device is assigned to the sheet transport drum of that sheet transfer device that is disposed first in the sheet transport direction. In this way, the sheet transfer device can be protected against becoming soiled by the dust or the contamination adhering to the rear side of the sheet of printing material.

In another embodiment of the sheet-fed rotary printing press, the sheet transfer device to which the second cleaning device is assigned is disposed directly downline of the first printing unit. In this manner, printing units located downline of the first printing unit and provided for printing the front side of the sheet of printing material, can be protected against being soiled by the dust adhering to the rear side of the sheet of printing material. Otherwise, this dust becomes deposited on the circumferential surface of the impression cylinder and collects there.

Another embodiment of the sheet-fed rotary printing press provides for the reversing device to include at least one sheet transport drum, and the second cleaning device is assigned to that sheet transport drum.

In another embodiment of the sheet-fed rotary printing press, the reversing device includes three sheet transport drums, and the second cleaning device is assigned to that sheet transport drum of the reversing device disposed first in the sheet transport direction. The ninth and tenth embodiments of the sheet-fed rotary printing press offer the advantage that the reversing device and the printing units downline of the reversing device are protected against becoming dusty.

In another embodiment of the sheet-fed rotary printing press, the first cleaning device is embodied as a cleaning unit disposed between a sheet feeder and the first printing unit.

In another embodiment of the sheet-fed rotary printing press, the second cleaning device is embodied as a cleaning unit disposed between the reversing device and the second printing unit. According to the invention, a cleaning unit is understood to be a separate module or station that includes extra transport elements for the printing sheets, provided especially for cleaning the sheets of printing material. For example, a cleaning unit has side frames comparable with the printing units, and between those side frames, one or more sheet transport drums belonging to the cleaning unit are rotatably supported. Instead of the sheet transport drums, chain gripper systems can, for example, also be used. Cleaning of the sheet of printing material takes place while the sheet of printing material is being transported through the cleaning unit. The eleventh and twelfth embodiments offer the advantage that the cleaning unit cleans the front side and the rear side, respectively, of the sheet, before an imprint is first made on the respective side.

In another embodiment of the sheet-fed rotary printing press, the second cleaning device is embodied as a cleaning unit disposed immediately preceding the reversing device in the sheet transport direction. This embodiment is directed to protecting both the reversing device and one or more of the printing units downline of the reversing device against contamination, and enabling high-quality printing on the rear side.

In another embodiment of the sheet-fed rotary printing press, the first cleaning device and the second cleaning device have identically constructed embodiments. This construction permits both the front side and the rear side to be cleaned equally well. In the event that one of the two sides of the sheet requires more thorough cleaning than the other side, it is also possible to use differently constructed cleaning devices for cleaning the front side and the rear side. This may be the case, for example, if the front side and the rear side are printed using different printing methods. It may also be the case if the sheet of printing material has different surface properties on the two sides thereof. Also, this is true if the printing properties of the printing ink used for printing the front side and the printing ink used for printing the rear side require cleaning to a different degree of thoroughness. As a rule, however, the first and second cleaning devices are identical, for example, being embodied as two cleaning units, each including a suction brush roller.

In another embodiment of the sheet-fed rotary printing press, at least one of the cleaning devices is embodied as a pneumatic cleaning device, in particular as a suction and/or blower device. With a cleaning device embodied in this way, the surface of the printing material can be cleaned especially gently.

In another embodiment of the sheet-fed rotary printing press, at least one of the cleaning devices is embodied as a stripper device, in particular as a brush, a roller, or a brush roller. With a cleaning device embodied in this way, an especially thorough cleaning of the surface of the printing material can be achieved.

In another embodiment of the sheet-fed rotary printing press, at least one of the cleaning devices is embodied as a pneumatically supported stripper device, in particular a suction brush. A cleaning device embodied in this way combines the advantages of the cleaning devices present in the two embodiments described hereinbefore. For example, gentle cleaning is possible because a rotating suction brush is pressed with comparatively slight force against the surface of the printing material. The contaminant particles are detached from the surface of the printing material by the bristles of the brush and then carried away by the suction action.

In another embodiment of the sheet-fed rotary printing press, the reversing device is embodied so as to be drivable selectively in recto printing mode and in verso printing mode. For example, a printing press encompassing eight printing units in in-line construction, with a reversing device disposed between the fourth and fifth printing units, can produce four-color printing on both sides of a sheet in one sheet pass (recto/verso printing mode), or more than four-color printing, such as eight-color printing, on one side (recto printing mode).

The method of the invention can be performed with sheet-fed rotary printing presses which operate by various printing methods and has many advantages, especially when performed on an offset sheet-fed rotary printing press. The sheet-fed rotary printing press of the invention can operate by one or more printing methods and is preferably embodied as an offset sheet-fed rotary printing press.

Other features which are considered as characteristic for the invention are set forth in the appended claims.

Although the invention is illustrated and described herein as a method for two-sided printing of a sheet of printing material, and a sheet-fed rotary printing press for performing the method, it is nevertheless not intended to be limited to the details shown, since various modifications and structural changes may be made the without departing from the spirit of the invention and within the scope and range of equivalence of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
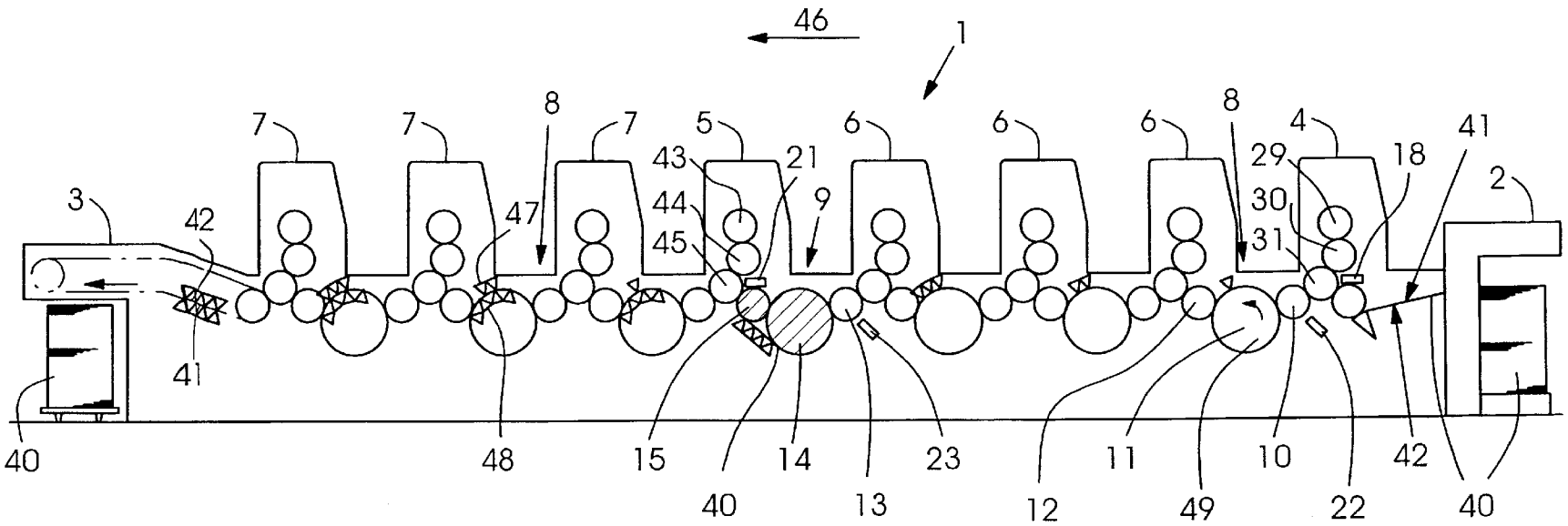
FIG. 1 is a diagrammatic side elevational view of an offset sheet-fed rotary printing press for two-sided printing a sheet of printing material.

Referring now to the drawings and, first, particularly to FIG. 1 thereof, there is shown therein a sheet-fed rotary printing press 1 with a sheet feeder 2 and a sheet delivery 3. The sheet-fed rotary printing press 1 is embodied with in-line construction, in which four printing units 4, 6 for printing the front side and four printing units 5, 7 for printing the rear side of a sheet of printing material 40 are disposed behind one another, in a row or line. Each printing unit 4 to 7 includes a printing form cylinder 29, 43, a rubber blanket cylinder 30, 44, and an impression cylinder 31, 45. The sheets of printing material 40 are transferred from one printing unit 4 to 7 to another printing unit 4 to 7 by sheet transfer devices 8 and a reversing or inverter device 9. Each sheet transfer device 8 includes one sheet transfer drum 10 disposed first in the sheet transport direction represented by the horizontal axis 46, another sheet transfer drum 11 located downline from the one transfer drum 10, and a third sheet transfer drum 12 located farther downline. The sheet transfer drums 10 to 12 and the inpression cylinders 31, 45 carry rows of grippers on the respective circumferential surfaces thereof for holding and guiding the sheet of printing material. The reversing device 9 also includes three sheet transfer drums 13 to 15, namely a transfer drum 13, a storage drum 14, and a reversing drum 15, all equipped with grippers, and are operatable in two modes. In a first operating mode, namely a recto printing mode, the sheet of printing material 40 taken over from the printing unit 6 immediately preceding the reversing device 9 is transferred to the next following printing unit 5 so that therein and in the succeeding printing units 7, just as in the printing units 4, 6 preceding the reversing device 9, the front side 41 of the sheet of printing material 40 can be printed. In the recto printing mode, the leading edge, held in the grippers of the sheet transfer or storage drum 14, is transferred to the grippers of the sheet transfer or reversing drum 15, so that the sheet of printing material 40 is printed on the front side thereof in the printing unit 5. In the verso printing mode shown in FIG. 1, the sheet of printable material 40, held by the leading edge thereof in the grippers of the sheet transfer or reversing drum 15, is grasped at the trailing edge thereof by the grippers of the sheet transfer drum 15 and thereby turned over, so that printing on the rear side thereof is performed in the printing unit 5. The symbols 47, 48 represent the particular ink color printed along the sheet transport direction 46. The symbol 48 signifies that the front side 41 of the sheet of printing material 40, in the verso printing mode, has been printed successively with four colors in the printing units 4, 6. The symbol 47 pertains to the rear side 42 of the sheet of printable material 40 facing upwardly in the verso printing mode, and signifies that so far two ink colors have been printed on the rear side 42 of the sheet of printing material 40 in the preceding printing units 5 and 7. The symbols 47 and 48 indicate the processing stage and the number of colors previously printed, respectively, after each printing unit 4 to 7. The sheet-fed rotary printing press 1 has a first cleaning device 18 for cleaning paper dust and contaminants from the sheet of printing material 40. The first cleaning device 18 is disposed in the first printing unit 4 and acts upon the front side of the sheet of printing material 40 guided on the impression cylinder 31. Also shown in FIG. 1 are three different locations at which the second cleaning device 21, 22, 23 may be disposed for cleaning the rear side 42 of the sheet 40. A first disposition of the second cleaning device 21 in the second printing unit 5 is identical to that of the first cleaning device 18 in the first printing unit 4. In this regard, it is noted that, in the description of the invention herein, the second printing unit 5 is understood in each case to mean the printing unit that prints the rear side 41 for the first time and that in FIG. 1 is located in the fifth position in the overall order. The second cleaning device 21 is thus disposed at the impression cylinder 41 so that it cleans the rear side 42 of the sheet of printing material 40 before the printing ink is transferred from the rubber blanket cylinder 44 to the sheet of printing material 40 in the printing nip defined by the cylinders 44 and 45. Alternatively, the second cleaning device 22 can also be assigned to the sheet transfer drum 10 immediately following the first printing unit 4, in which case the sheet of printing material 40 rests with the front side thereof on the sheet transfer drum 10, and the rear side thereof is cleaned by the cleaning device 22. The disposition of the sheet of printing material 40 on the sheet transfer drum 10 is due to the rotational directions shown. A third alternative is to assign the second cleaning device 23, that cleans the rear side 42 of the sheet 40, to the first sheet transfer drum 13 of the reversing device 9. This disposition is, in substance, equivalent to the disposition of the second cleaning device 22. It is understood that, as required, a plurality of second cleaning devices 21 to 23 may be provided, in combination, for cleaning the rear side 42 of the sheet 40.

Figure 2:
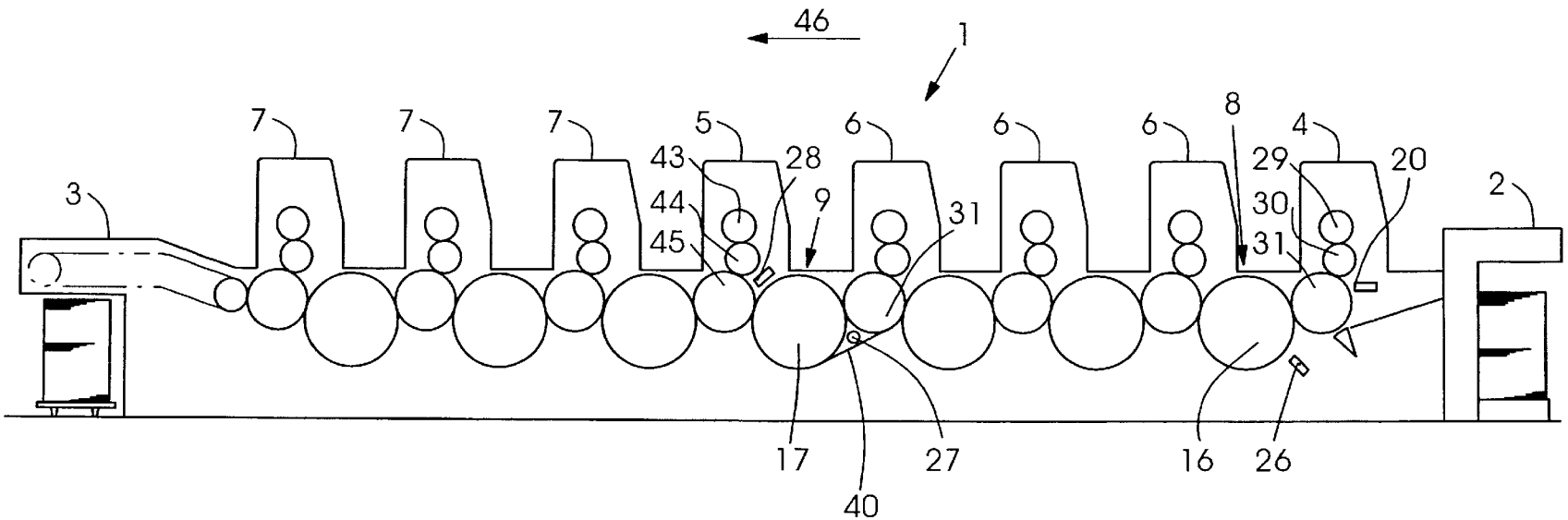
FIG. 2 is a view like that of FIG. 1, wherein the sheet-fed rotary printing press has at least two cleaning devices.

The sheet-fed rotary printing press 1 shown in FIG., 2 is largely equivalent to the sheet-fed rotary printing press 1 shown in FIG. 1. Illustrated in FIG. 2, in terms of this embodiment of the sheet-fed rotary printing press 1, is how cleaning devices 20, 26, 27 and 28 are disposed if the sheet transfer devices 8 and/or the reversing device 9 include only a respective single sheet transfer drum 16, 17. The first cleaning device 20 is assigned to the impression cylinder 31, again in the region of the entry nip defined thereby together with the rubber blanket cylinder 30. In the case of a direct printing method, the first cleaning device 20 and the first cleaning device 18 (FIG. 1) may also be disposed in the region of an inlet nip, formed between the printing form cylinder 29 and the impression cylinder 31, upline of the printing nip. The disposition of the second cleaning device 28, that cleans the rear side 42 of the sheet of printing material 40, is virtually equivalent to the disposition of the first cleaning device 20. The second cleaning devices 21 to 28 (FIGS. 1 to 4) provided for cleaning the rear side 42 of the sheet 40 can obviously be shut down, when the sheet-fed rotary printing press 1 is operating in the recto printing mode. This is expedient particularly with cleaning devices 21, 24, 28 which contact the sides of the sheets to be cleaned and are disposed downline from the reversing device 9, because otherwise, in the recto printing mode, the printing inks or colors printed on the front side of the sheet in the printing units 4, 6 might be smeared and scraped off by the second cleaning device 21, 24, 28 embodied, for example, as a brush roller. Such a brush roller, for example, can be stopped by the impression cylinder 45, so that the sheet of printing material 40 can be moved past without contact between the second cleaning device 21, 24, 28 and the front side 41 to be printed subsequently in the printing units 5, 7. A further special feature of the sheet-fed rotary printing press 1 shown in FIG. 2 manifests itself with the assignment of the second cleaning device 27 to the reversing device 9. In the reversing device 9, that has only a single sheet transfer drum 17, the sheet of printing material 40 that is retained by the impression cylinder 31 with grippers which hold it at the leading edge thereof, is reversed by being up-ended or turned over, the grippers of the sheet transfer drum 17 gripping the trailing edge of the sheet of printing material 40. The sheet of printing material 40, that is stretched, in the verso printing mode, between the sheet transfer drum 17 and the impression cylinder 31, is disposed so that the rear side thereof that is to be cleaned faces towards the nip formed between the sheet transfer drum 17 and the impression cylinder 31, as shown in FIG. 2. When the cleaning device 27 is disposed inside the nip, so that it is spanned by the sheet of printing material 40, in the verso printing mode, the transfer of the sheet of printing material 40 from the grippers of the impression cylinder 31 to suction devices or grippers of the sheet transfer drum 17 is taken into account. Advantageously, a cleaning device 27 disposed with the end face thereof and laterally, respectively, outside the respective printing width and axial length of the impression cylinder 31 and the sheet transfer drum 17, respectively, may, for example, be embodied as a blower device for blowing off dust from the rear side of the sheet of printing material 40 and for blowing a stream of air laterally into the nip covered by the sheet of printing material 40.

Figure 3:
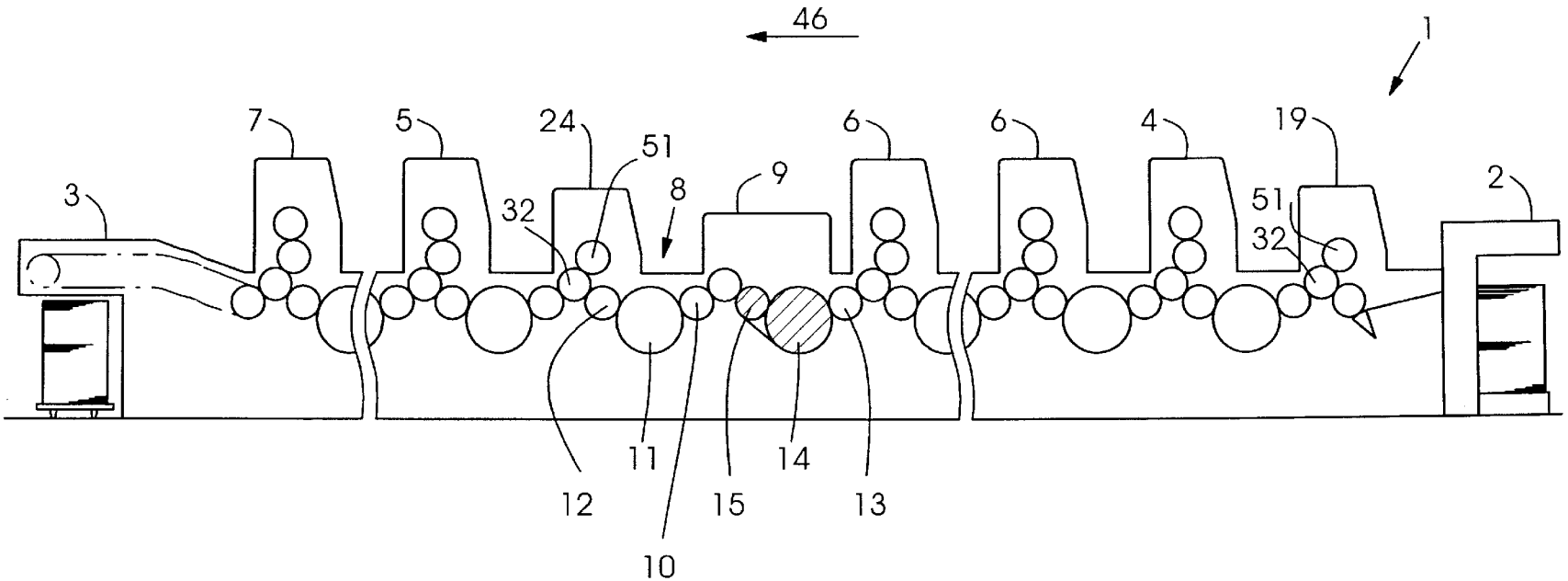
FIG. 3 is another view like those of FIGS., 1 and 2, wherein the sheet-fed rotary printing press has two cleaning devices embodied as one cleaning unit.

In FIG. 3, a sheet-fed rotary printing press 1 is shown which is embodied essentially like the sheet-fed rotary printing press 1 shown in FIGS. 1 and 2. In a departure from the latter, the first cleaning device 19 and the second cleaning device 24 are each embodied as a separate cleaning unit. The reversing device 9, disposed between the last printing unit 6 that prints the front side of the sheet of printing material 40 and the second cleaning device 24, is also embodied as a station (reversing unit) that is separate from the printing units 4 to 7. The first cleaning device 19 that cleans the front side of the sheet, and the second cleaning device 24 that cleans the rear side of the sheet are shown as being of virtually identical construction, but they may also be constructed differently. Here, the first cleaning device 19 takes the sheet of printing material from the sheet feeder 2 and transfers it, after cleaning the front side of the sheet, to the first printing unit 4. The second cleaning device 24 takes the sheet of printing material from the reversing device 9 and transfers it, after cleaning the rear side of the sheet, to the second printing unit 5. In the first printing unit 4, the first colored printing ink or the single printing ink is applied to the front side, and in the second printing unit the first colored printing ink or the single printing ink is applied to the rear side of the sheet of printing material. The cleaning devices 19, 24, constructed as cleaning units, include sheet transport mechanisms, such as chain gripper systems, or one or more sheet transfer drums 32, as shown, supported between the side frames of the cleaning devices 19, 24. The embodiment of the cleaning devices 19, 24 is advantageous especially whenever the cleaning method employed requires a cleaning device that takes up a large amount of space. For such a cleaning device 19, 24, adequate space is often not available in the region of the printing units 4, 5. Furthermore, easy maintenance and care of the cleaning device 19, 24 is possible if the cleaning units are readily accessible. In FIG. 3, each cleaning device 19, 24 embodied as a cleaning unit includes at least one sheet transfer drum 32, that feeds the sheet of printing material, holding it in grippers, in the same way as the sheet transfer drums 10, 15. To each sheet transfer drum 32, there may be assigned a stripper device, an electrostatic device, a blower device, a brush roller, a vacuuming device or the cleaning roller 51 that is shown in FIG. 3.

Figure 4:
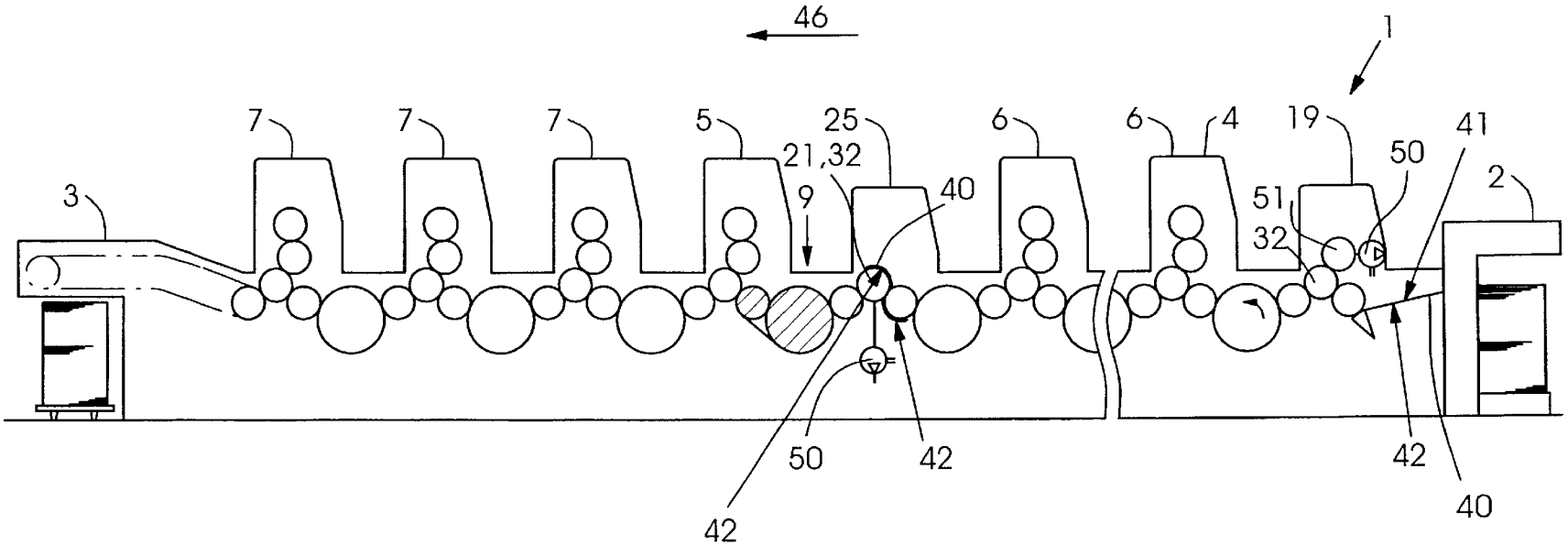
FIG. 4 is a further view like those of FIGS. 1, 2 and 3, wherein the sheet-fed rotary printing press has two cleaning units.

The sheet-fed rotary printing press 1 shown in FIG. 4 differs from the sheet-fed rotary printing press 1 shown in FIG. 3 in the disposition of the second cleaning device 25, that cleans the rear side of the sheet, immediately upline of the reversing device 9 and downline of the printing unit 6 that is the last to print the front side of the sheet of printing material. In this embodiment, the reversing device 9 is not embodied as a separate reversing unit, but is instead embodied comparably to the reversing devices 9 shown in FIGS. 1 and 2. The cleaning devices 19, 25, respectively, include at least one sheet transport or transfer drum 32 supported rotatably between the side frames. The sheet transport drum 32 of the first cleaning device 19 transports the sheet of printing material 40, that lies with the rear side thereof on the transport drum 32, while the front side of this sheet is cleaned by the cleaning roller 51 that is embodied as a suction roller. The sheet transport drum 32 of the second cleaning device 25, at the same time, functions both for transporting sheets of printing material and for cleaning them. The rear side of the sheet of printing material 40 lies on the sheet transport drum 32 of the second cleaning device 25 and is simultaneously cleaned. For that purpose, a suitable number of suction openings for vacuuming up the dust may be provided, the suction openings being distributed over the entire circumferential jacket surface of this sheet transport drum 32. The cleaning roller 51 and the sheet transport drum 32 of the second cleaning device 25 are respectively connected to one suction source 50.

Figure 5:
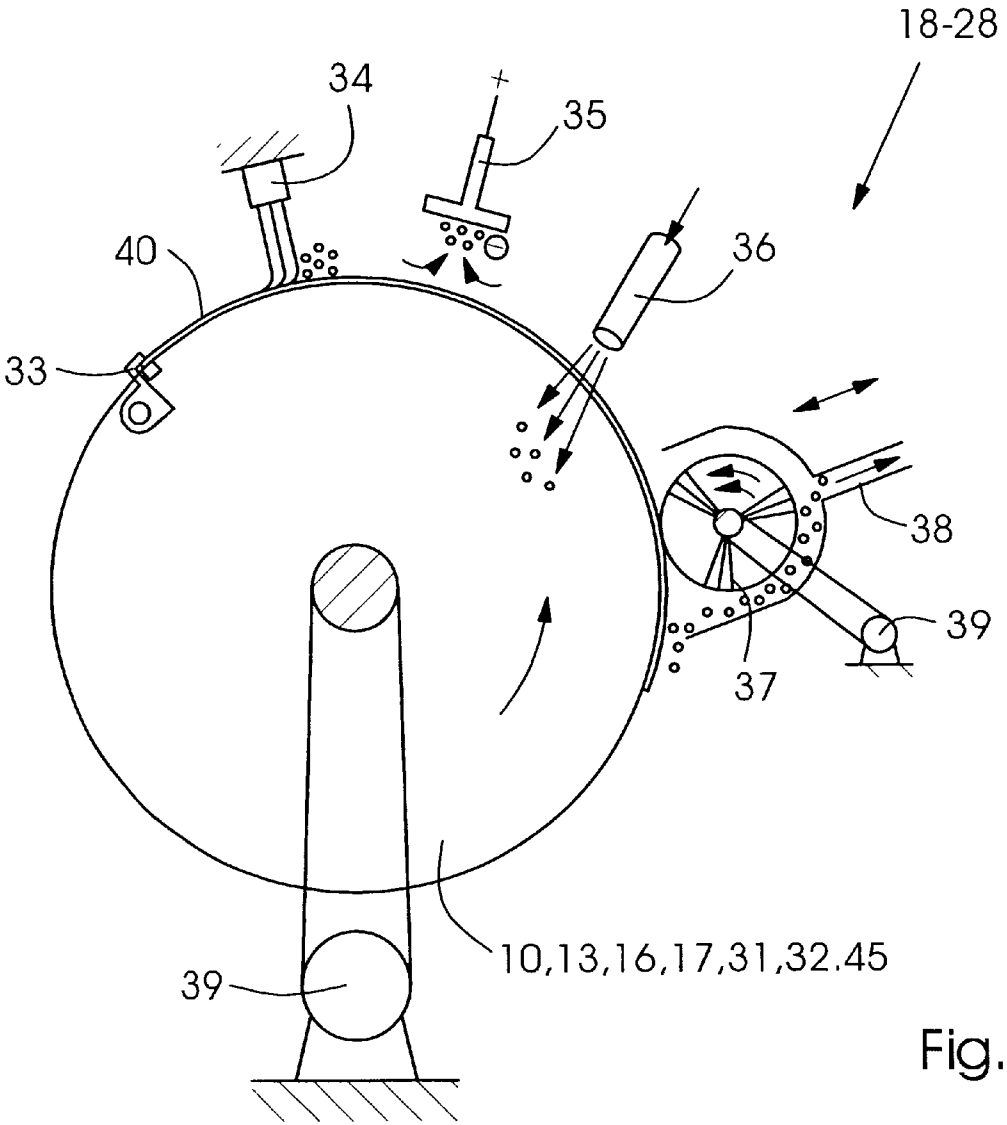
FIG. 5 is a diagrammatic side elevational view of a sheet transfer roller with various different sheet-cleaning devices disposed adjacent thereto.

In FIG. 5, various possible embodiments 34 to 38 of the first cleaning device 18, 19, 20 and the second cleaning device 21 to 28 are shown. The cleaning devices 34 to 38 are assigned to a sheet transport drum 10 to 17, an impression cylinder 31, 45, or a sheet transport drum 32, and are disposed in the region of the periphery of the drum 32, so that the sheet of printing material guided on the respective cylinder or drum can be cleaned. The sheet of printing material 40 is held and guided in the grippers 33 of the drum or cylinder. The cylinder or drum is rotated by a drive mechanism 39. The cleaning device 34 is embodied as a brush strip or bar that preferably extends axially parallel across the width of the cylinder or drum and that sweeps the dust from the surface of the printing material. The stripper device 34 sweeps over the surface to be cleaned. The electrostatic device 35 removes particles opposite in polarity thereto by electrostatic attraction. The blower device 36 blows the dust off the surface of printed material to be cleaned. The brush roller 37 rotates preferably contrary to the direction of rotation of the drum or cylinder. The brush roller 37 preferably rotates at a circumferential speed other than the circumferential speed of the drum or cylinder, so that the contaminants will be reliably brushed off. The brushed-off contaminants are vacuumed away by the vacuuming device 38 which, as shown, may be combined with the brush roller 37, contaminants being deposited in a non-illustrated filter, for example. The brush roller 37 is driven by the drive mechanism 39.

The invention encompasses any possible combination of one or more of the first cleaning devices 18, 19, 20 shown in FIGS. 1 to 5, with one or more second cleaning devices

21 to 28 shown in the same figure of the drawings or in a different one of the FIGS. 1 to 5. Preferred combinations, respectively, are represented in FIGS. 1 to 5.

We claim:

1. A method for two-sided printing of a sheet of printing material having a front side and a rear side, in a sheet-fed rotary printing press, which comprises:

the following method steps performed in the following order: cleaning a front side of the sheet, printing on a front side of the sheet, cleaning a rear side of the sheet, and printing on the rear side of the sheet.

2. The method according to claim 1, wherein the printing on the front and the rear sides of the sheet is multicolor printing.

3. The method according to claim 1, which includes performing the steps in a sheet-fed rotary printing press embodied as a recto/verso printing press.

* * * * *